United States Patent [19]

Pulliam

[11] 4,039,140

[45] Aug. 2, 1977

[54] NAIL EXTRACTOR

[75] Inventor: Barron Pulliam, Chatsworth, Ga.

[73] Assignee: The Raymond Lee Organization, Inc., New York, N.Y. ; a part interest

[21] Appl. No.: 696,137

[22] Filed: June 14, 1976

[51] Int. Cl.[2] ..... B66F 15/00

[52] U.S. Cl. ..... 254/25

[58] Field of Search ..... 254/21, 25, 26, 23, 254/19

[56] References Cited

U.S. PATENT DOCUMENTS

| | | | |
|---|---|---|---|
| 62,012 | 2/1867 | Cornelius | 254/21 |
| 724,542 | 4/1903 | Brownell | 254/26 R |
| 1,515,142 | 11/1924 | Butler | 254/25 |
| 1,535,685 | 4/1925 | Randell et al. | 254/26 R |
| 1,835,443 | 12/1931 | Swoyer et al. | 254/25 |
| D. 30,786 | 5/1899 | Brownell | 254/26 |

*Primary Examiner*—Al Lawrence Smith
*Assistant Examiner*—Robert C. Watson
*Attorney, Agent, or Firm*—Howard I. Podell

[57] ABSTRACT

A tool for removing nails in the form of a bar curved to form a fulcrum at its working end, which terminates as a short first forked claw. A second forked claw of intermediate length is fixed at a second distance from the fulcrum and a long third fork claw is fixed at a second distance from the fulcrum with all forked claws being generally similarly curved and extending in the same direction from the bar. The second and third claws are used to fasten about a nail head which has been partially lifted above the surface on which the fulcrum is rested, for complete removal of the associated nail.

1 Claim, 4 Drawing Figures

FIG.1
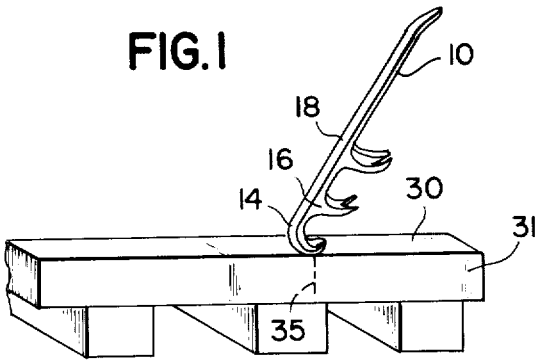
FIG.2
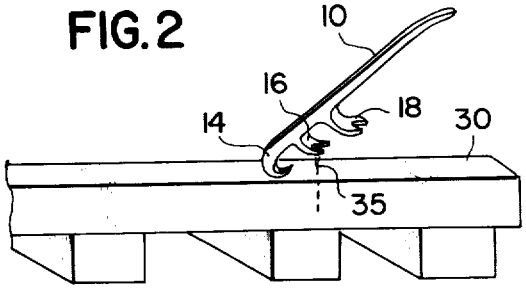
FIG.3
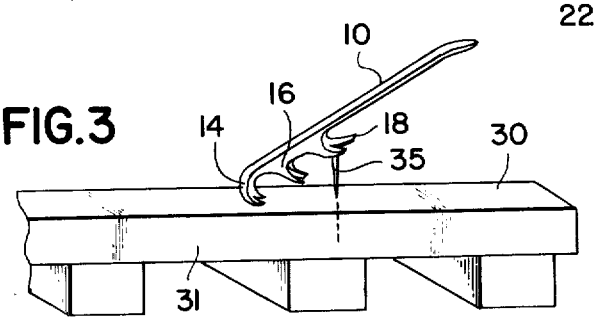
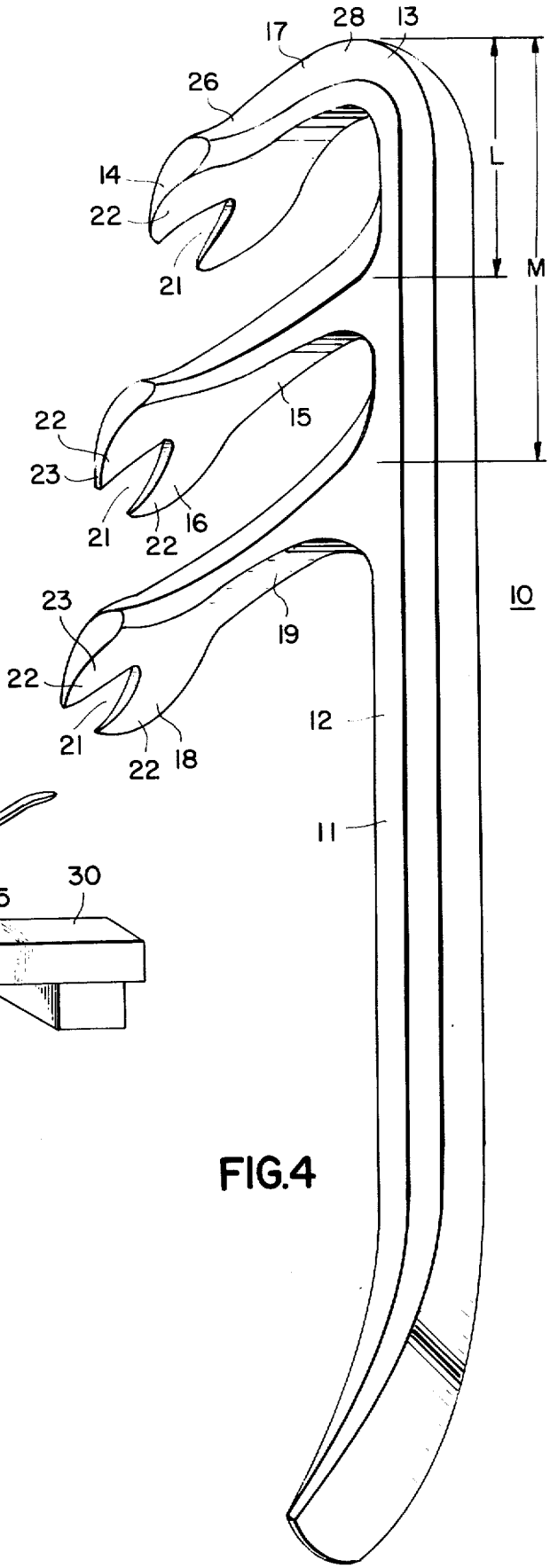
FIG.4

NAIL EXTRACTOR

BACKGROUND OF THE INVENTION

Nail extractors have been customarily formed of a curved bar or hammer head shaped at its external end in the form of a claw formed with a wedge-shaped opening to receive the shank of a nail. Such devices are highly satisfactory for starting the removal of a nail, embedded into a block, utilizing the external curved surface of the bar as a fulcrum, and rotating the bar with the claw grasping the nail head. However, as the nail head is lifted above the surface of the fastened block, the claw ceases to move in the axial direction of the fastened nail and bends the nail, without further extraction. Swoger, et al, (U.S. Pat. No. 1,835,433) has designed a bar formed with a pair of claws at the terminal end of a bent bar, in which the first claw becomes the fulcrum, with the second claw employed to lift a partially removed nail.

In this invention, the bar is shaped with a first curved claw extending from the terminal end of the bar and a plurality of additional curved claws, each fastened to the bar beyond the external curved fulcrum section so that the nail may be removed with a minimum of bending of the nail, minimizing the force required and permitting reuse of the nail.

SUMMARY OF THE INVENTION

My invention is a tool for removing nails in the form of a bar curved to form a fulcrum at its working end, which terminates as a short first forked claw. A second forked claw of intermediate length is fixed at a first distance from the fulcrum and a long third fork claw is fixed at a second distance from the fulcrum with all forked claws being generally similarly curved and extending in the same direction from the bar. The second and third claws are used to fasten about a nail head which has been partially lifted above the surface on which the fulcrum is rested, for complete removal of the associated nail.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention, employed to start the removal of a nail, fastened in a block;

FIG. 2 is a perspective view of the invention, employed to continue the removal of the nail, after it has been initially loosened;

FIG. 3 is a perspective view of the invention, employed to complete the removal of the nail, after it has been raised from the block; and FIG. 4 is a perspective view of the invention.

DESCRIPTION OF THE PREFERRED EMBODIMENT

Turning now descriptively to the drawings, in which similar reference characters denote similar elements throughout the several views, FIGS. 1–4 illustrate the nail extractor 10 which is formed of a bar 11 formed of a generally straight section 12 that joins a curved section 13 terminating in a first claw 14. A straight shank section 15, terminating at its free end in a second claw 16, is joined to the straight section 12 of the bar 11 at a first distance L from the external fulcrum surface 17 of the fulcrum section 28 of the curved section 13. A third claw 18 is joined by a straight shank section 19 to the straight section 12 of bar 11 at a distance M from the external fulcrum surface 17 of the bar 11.

Each claw 14, 16 and 18 is formed with a wedge-shaped opening 21 of a size to receive and engage a shank of a nail with the head of the nail resting against the inside surface 22 of the times 23 of the claw.

Shank section 15 is shorter than shank section 19 and larger than the shank section 26 of curved 13 joining claw 14 to the fulcrum section 28, with all the axis of all shank sections 15, 19 and 26 extending in a generally common plane from the axis of the straight section 12 of bar 11.

The location of shank sections 15 and 19 on the straight section 12 of bar 11, and separated from claw 14 on curved shank 26 by fulcrum section 28, and with distance M being greater magnitude than distance L, enables each claw 14, 16 and 18 to pull a nail 35 along the relatively straight axis of the nail, for a specific distance from the surface 30 of a blade 31 in which the nail 35 has been initially embedded, with the sum of these distances being equal to the length of the nail 35.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A nail extractor for the purpose of removing an embedded nail substantially along the straight axis of the nail, comprising a bar formed with a generally straight section joined to a convex curved section that serves as a fulcrum section which fulcrum section is joined to a first shank section terminating in a first claw of a size to grip a nail, a second shank section joined to the straight section of the bar at a first distance from the fulcrum section of the bar, and a third shank section joined to the straight section of the bar at a second distance from the fulcrum section, said second distance being greater than said first distance, said second and third shank sections each terminating in a claw of similar shape to the first said claw, with said claws each extending in the same general direction from the axis of the bar, and with said second shank section longer than said first shank section and shorter than said third shank section, said second and said third shank sections each extending along a substantially straight line from said bar, with each said claw formed with a V-shaped recess in which a nail may be gripped.

* * * * *